US009611676B2

(12) United States Patent
Bendel

(10) Patent No.: US 9,611,676 B2
(45) Date of Patent: Apr. 4, 2017

(54) LOCK FOR A MOTOR VEHICLE

(71) Applicant: Kiekert Aktiengesellschaft, Heiligenhaus (DE)

(72) Inventor: Thorsten Bendel, Oberhausen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 0 days.

(21) Appl. No.: 14/892,618

(22) PCT Filed: May 19, 2014

(86) PCT No.: PCT/DE2014/000252
§ 371 (c)(1),
(2) Date: Nov. 20, 2015

(87) PCT Pub. No.: WO2014/187445
PCT Pub. Date: Nov. 27, 2014

(65) Prior Publication Data

US 2016/0090758 A1 Mar. 31, 2016

(30) Foreign Application Priority Data

May 23, 2013 (DE) ..... 10 2013 209 599

(51) Int. Cl.
*E05C 3/06* (2006.01)
*E05B 79/10* (2014.01)
(Continued)

(52) U.S. Cl.
CPC ..... *E05B 79/10* (2013.01); *E05B 77/06* (2013.01); *E05B 85/243* (2013.01); *E05B 85/26* (2013.01)

(58) Field of Classification Search
CPC ..... E05B 79/10; E05B 79/22; E05B 85/02; E05B 85/20; E05B 85/24; E05B 85/243;
(Continued)

(56) References Cited

U.S. PATENT DOCUMENTS 3,695,662 A * 10/1972 Ploughman ..... E05B 85/243 292/216
9,109,380 B2 8/2015 Kiekert
(Continued)

FOREIGN PATENT DOCUMENTS

DE 29622837 U1 9/1997
DE 20104625 U1 9/2002
(Continued)

OTHER PUBLICATIONS

Machine Translation of DE20104625U1 by Lexis Nexis Total Patent on Nov. 17, 2015.
(Continued)

*Primary Examiner* — Hanh V Tran
(74) *Attorney, Agent, or Firm* — Woodard, Emhardt, Moriarty, McNett & Henry LLP

(57) ABSTRACT

A motor vehicle door closure includes a locking mechanism having a rotary latch and a locking pawl for locking the rotary latch. The door closure also includes a blocking pawl for blocking the locking pawl when engaging, a release lever for releasing the locking pawl, and a locking lever that blocks the locking mechanism at least in the event of acceleration forces of a predetermined magnitude occurring, for example in an accident (impact). The release lever and the locking lever are arranged about an axis. This results in a particularly simple lock design.

19 Claims, 1 Drawing Sheet

(51) Int. Cl.
*E05B 77/06* (2014.01)
*E05B 85/26* (2014.01)
*E05B 85/24* (2014.01)

(58) Field of Classification Search
CPC ..... E05B 85/26; E05B 77/02; E05B 77/04; E05B 77/06
See application file for complete search history.

(56) References Cited

U.S. PATENT DOCUMENTS

2003/0218340 A1* 11/2003 Coleman ..... E05B 77/06 292/169.11
2005/0140147 A1* 6/2005 Spurr ..... E05B 85/26 292/216
2008/0224482 A1* 9/2008 Cumbo ..... E05B 77/02 292/216
2009/0199605 A1* 8/2009 Spurr ..... E05B 81/14 70/266
2011/0133495 A1* 6/2011 Jankowski ..... E05B 77/12 292/336.3
2011/0204660 A1* 8/2011 Cumbo ..... E05B 85/243 292/217
2011/0210565 A1* 9/2011 Scholz ..... E05B 85/26 292/200
2012/0110920 A1* 5/2012 Takagi ..... E05B 77/06 49/503
2012/0175896 A1* 7/2012 Martinez ..... E05B 81/06 292/199
2013/0015670 A1 1/2013 Perkins
2014/0035295 A1 2/2014 Kiekert

FOREIGN PATENT DOCUMENTS

DE 102008061524 A1 6/2010
DE 102010010833 A1 9/2011
DE 102011010816 A1 8/2012
EP 1518983 A2 3/2005

OTHER PUBLICATIONS

Machine Translation of DE29622837U1 by Lexis Nexis Total Patent on Nov. 17, 2015.
Machine Translation of DE102008061524A1 by Lexis Nexis Total Patent on Nov. 17, 2015.
Machine Translation of EP1518983A2 by Lexis Nexis Total Patent on Nov. 17, 2015.

* cited by examiner

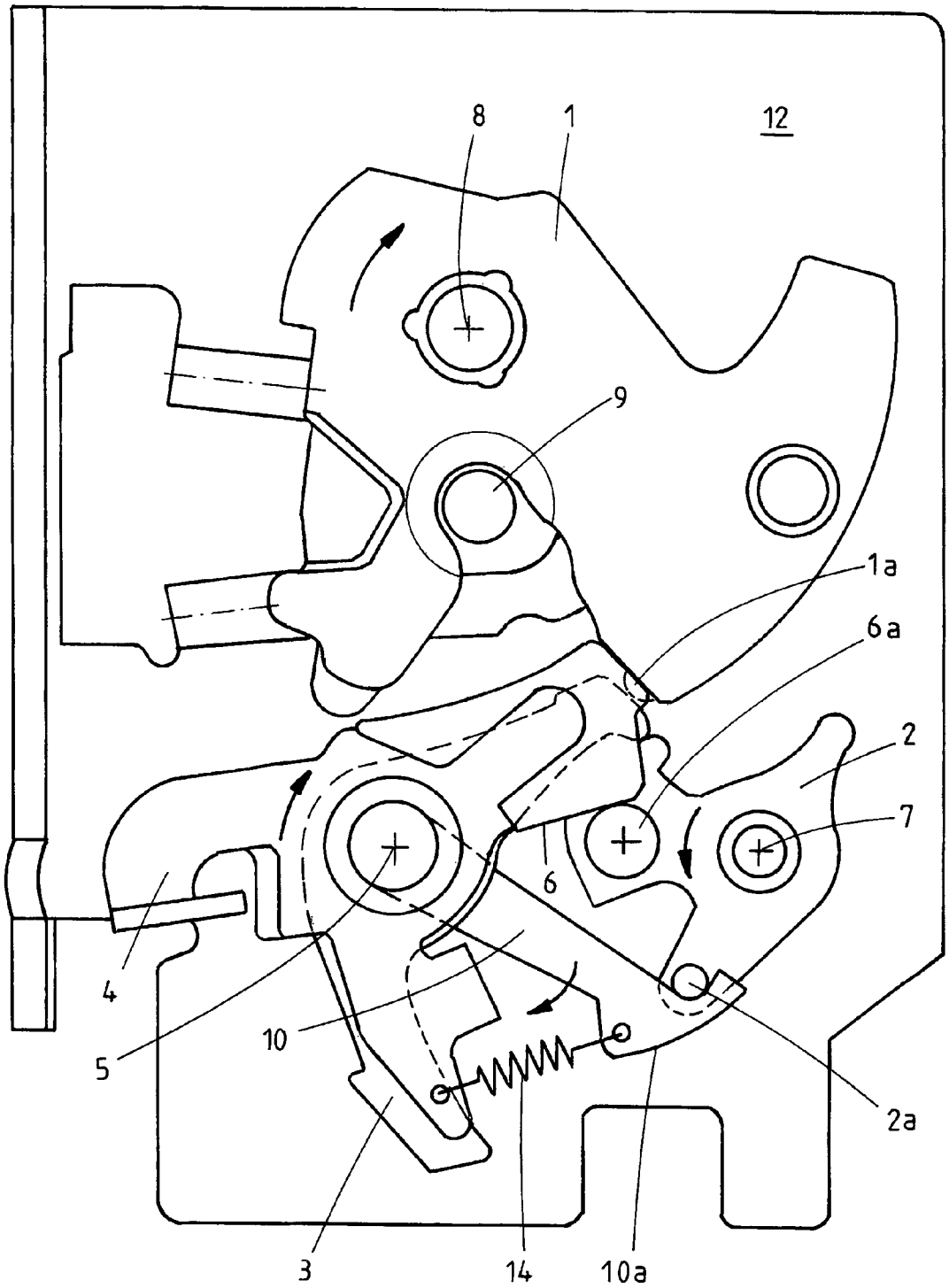
8
1
12
9
1a
6a
2
7
6
4
5
10
2a
3
14
10a

LOCK FOR A MOTOR VEHICLE

CROSS-REFERENCE TO RELATED APPLICATIONS

This application is the U.S. national stage application of International Patent Application No. PCT/DE2014/000252, filed May 19, 2014, which claims priority of German Application No. 10 2013 209 599.6, filed May 23, 2013, which are both hereby incorporated by reference.

BACKGROUND

The invention relates to a lock, in particular for a motor vehicle containing a locking mechanism comprising a catch and a pawl for locking the catch in a ratchet position, a blocking lever (also referred to as a blocking pawl or latching pawl) for blocking the pawl in its ratchet position and a release lever for opening the locking mechanisms, in particular, by moving the blocking lever out of its blocking position and a blocking lever that blocks the locking mechanism at least in the event of acceleration forces of a predetermined magnitude occurring, for example in case of an accident (crash).

The motor vehicle door closure or simply referred to as a lock for a motor vehicle, comprises a locking mechanism with a rotatably mounted catch, accommodating a locking bolt, normally arranged on the motor vehicle and that is often also referred to as lock holder or lock bracket. The locking mechanism also contains a pawl for locking the catch in order to retain the locking bolt.

The catch of a motor vehicle door lock also contains a fork-like infeed slot (also referred to as an infeed section) formed by a load arm and a collecting arm, which is entered into by the locking bolt of a motor vehicle door or hatch, such as also a motor bonnet or tailgate, when the door or hatch is closed. The locking bolt then rotates the catch from an opening position in the direction of the closed position until the pawl locks the catch. The locking bolt can then not leave the inlet slot of the catch.

In previous years, motor vehicle locks have been established in which, due to a respective design of the latching surface, the catch can introduce an opening moment into the pawl if the pawl is in the latching position, i.e. the catch produces an opening moment in relation to the pawl. Such a lock requires a blocking lever for blocking the pawl in the detent position. The blocking lever must be pivoted or turned out of its blocking position for the pawl to be able to leave its ratchet position for opening of the locking mechanism. Such locks, known, for instance from DE 10 2008 061 524 A1 are particularly easy to operate and can, in particular, be opened with little force.

Motor vehicle door locks are available that contain two ratchet positions, a pre-ratchet and a main ratchet position. The pre-ratchet position serves to capture the respective door or bonnet if it does not reach the main ratchet during closing. If the catch is turned further from the pre-ratchet position, it finally reaches the main ratchet position.

A lock generally contains a release lever, required to open or unlatch a locking mechanism. Such a release lever is typically connected to a door or bonnet. It can be an external or an internal handle of the respective door. Where such a handle is activated, the release lever is activated or pivoted in order to release the locking mechanism and thus open the lock.

In the event of an accident or a vehicle collision, hereinafter also referred to as a crash, extremely high acceleration forces equal to a multiple of the earth's acceleration can suddenly be generated. As a result, the respective lock including the lever mechanisms, such as the actuation lever of the motor vehicle, is exposed to considerable gravitational forces, that could cause unintentional opening of the locking mechanism and thus opening of the associated lock. In the event of a crash, also the actuation lever, i.e. an internal or external lever can be unintentionally opened, which could also cause the locking mechanism to be opened. It must be ensured that such a lock cannot unintentionally open in such a situation.

Based on the described scenarios, vehicle users are exposed to considerable danger. An unintentionally opened motor vehicle door can no longer provide any integral safety equipment such as a side airbag or side impact protection for the protection of the passengers of the vehicle. For this reason certain measures have been implemented in the past which in the event of the occurrence of the described abnormal acceleration forces, i.e. in the event of a crash, either block the lock actuation or the locking mechanism. A so-called inertia lock can be provided, which is in its resting position under normal operating conditions and which is then not engaged in the locking mechanism/lever mechanism.

In order to ensure that a lock does not open unintentionally in the event of a crash, document EP 01 518 983 A2 discloses a lock with a locking mechanism, comprising at least one actuating lever for releasing or opening the locking mechanism, i.e. a release lever. The lock also contains a locking lever, safely blocking the actuating lever during specified vehicle accelerations.

Document DE 10 2011 010 816 A1 discloses a lock with a locking mechanism containing a catch and a pawl for locking the catch. The lock is a lock with an opening moment, able to move the catch into the pawl in the ratchet position. The lock also contains a blocking pawl or blocking lever for blocking the pawl in the ratchet position. The arrangement also features a release lever for opening or actuating the locking mechanism.

In the event of a crash particularly high accelerations occur compared to the usual opening operation. Where the actuating lever only blocks during high vehicle accelerations, as experienced in the event of a crash, unintentional opening of the locking mechanism in the event of a crash can be prevented. In case of a usual actuation of the door handle, the actuating lever is not blocked due to the high acceleration, allowing opening of the lock.

In the event of a crash, a bounce-back can occur as a result of the excessively high acceleration forces, also referred to as bouncing. A delayed or repeated bounce-back, coupled, in particular, with changes to the acceleration forces and directions can result in a failure of the blocking device in the event of high accelerations, aiming to prevent unintentional opening of the lock in the event of a crash.

SUMMARY

The invention has the task of providing a lock that also cannot unintentionally open in the event of a crash. The object of the invention aims, in particular, to provide a lock that apart from offering a reliable function, also requires little space, contains few components and is thus easy to install.

In order to solve this task, a lock is provided, in particular for a motor vehicle door including a locking mechanism comprising a catch and a pawl for locking the catch. The lock preferably includes a blocking pawl or a blocking lever for blocking the pawl during latching. It contains a release lever for releasing, with the aid of which the locking mechanism can be unlatched or opened. The lock contains a blocking lever, protecting the locking mechanism against unintentional opening at least in the event of acceleration forces of a predetermined magnitude, for example in case of an accident (crash). The release lever and the blocking lever are arranged about an axis The lock only contains one bearing point for the release lever and the blocking lever, making it particularly easy to produce the lock. In addition, the pivoting area of the blocking lever is small thus allowing a compact lock design.

In one embodiment, the blocking lever contains a blocking contour interacting with the locking mechanism. This contributes to the fact that the lock cannot open in the event of a crash.

In one embodiment of the invention, the blocking lever can prevent the blocking pawl from leaving its blocking position. In a particularly simple embodiment, the blocking lever contains a blocking contour, able to engage with the blocking pawl. For this interaction, the blocking lever preferably has an offset section containing the blocking lever cam at the end opposite the bearing to allow for a particularly small design.

In a further embodiment of the invention, the release lever, the pawl and the blocking lever are mounted on one axis, in order to reduce the number of components used.

In a further preferred embodiment, the locking mechanism and the blocking lever arranged on the axis of the release lever are mounted in a lock casing.

In one embodiment, the blocking lever is mechanically coupled to the release lever. In a particular embodiment, the blocking lever is elastically coupled to the release lever. Both embodiments contribute to prevent opening in the event of a crash in an easy manner.

In a further embodiment, the blocking lever and the release lever are elastically connected by at least one spring and preferably by a spiral spring hooked into the offset section at the blocking lever end in order to provide an even simpler and more compact lock design.

In one embodiment, the moment of inertia of the blocking lever in the event of a crash, i.e. when exposed to accelerations of a certain magnitude, prevents movement of the blocking lever in such a way that the lock cannot open.

In a further embodiment, the forces of inertia of the blocking lever occurring in the event of a crash, clearly exceed any coupling forces to the release lever, in order to reliably prevent opening in the event of a crash.

In a further embodiment, the catch can exert an opening moment into the pawl, in order to particularly easily engage with the locking mechanism.

BRIEF DESCRIPTION OF THE DRAWING

Below, the invention is explained in detail with reference to a FIGURE. The only FIGURE shows a schematic overview of the motor vehicle door lock of the invention.

DETAILED DESCRIPTION OF THE DRAWING

The FIGURE shows a motor vehicle door lock containing a locking mechanism 1, 2, 3 comprising a catch 1, a blocking pawl 2 and a pawl 3. The locking mechanism is in the main ratchet position, which means that the pawl 3 is engaged in catch 1 in the main ratchet position of the catch 1. The catch 1 can also contain a pre-ratchet position. A release lever 4 is provided for actuation of the locking mechanisms 1, 2, 3 connected to at least one actuating lever—not shown—of the respective door of the motor vehicle. The actuating levers are generally the external door or internal door handle.

In order to open the locking mechanism 1, 2, 3, i.e. to move the pawl 3 out of its detent position, the release lever 4 is pivoted around its axis 5 in clockwise direction, as shown by an arrow in the FIGURE. As a result, an edge 6 of the release lever 4 engages with a journal 6*a* of the blocking pawl 2. This causes the blocking pawl 2 to move in counter-clockwise direction around its axis 7, as indicated by the arrow. As soon as the blocking pawl 2 has lifted off the pawl 3, the catch 1 can be pivoted around its axis 8 in clockwise direction, with the aid of a spring and release a locking bolt 9. The locking bolt 9 is connected to a motor vehicle door, not shown.

The further general design of the motor vehicle door lock includes a blocking lever 10, rotatably mounted together with a release lever 4 about an axis 5.

The axis 8 of the catch 1, the axis 7 of the blocking pawl 2, the axis 5 of the release lever 4 and of the blocking lever 10 are arranged on a lock case 12. These can be bearing journals essentially aligned parallel to each other and that are mainly secured perpendicularly to a surface area of the lock case 12. This is only an example and does not restrict the invention in any way.

The blocking lever 10 is designed as a pivoting lever 10, pivotable around axis 5. The blocking lever 10 is a single-arm lever with an offset section 10*a* in the direction of the blocking pawl 2. The offset section 10*a* of the blocking lever 10 is designed in such a way that a cam 20 arranged on the blocking pawl 2 can be clasped on the circumference side.

In normal operation shown in the FIGURE, the blocking lever 10 ensures that the blocking pawl 2 is blocked in the event of a crash and cannot carry out the counter-clockwise movement around axis 7 indicated during opening and which is initiated by the release lever 4 in case of its actuation. The locking mechanism 1, 2, 3 remains engaged as the blocking lever 10 prevents the blocking pawl 2 from leaving its blocking position.

On one hand, the blocking lever 10 is mounted on an axis 5 together with the release lever 4 and is, on the other hand, elastically coupled to the release lever 4 by means of a spring 14. This spring 14 connects the blocking lever 10 and the release lever 4 with each other. In this arrangement, the spring 14 is preferably connected to the end of the blocking lever 10 on the opposite side to the offset section 10*a* of the blocking lever 10. As shown, a bent end of the spring can be held in a hole in the in blocking lever 10 and also in an arm, in particular at a free end of such an arm of the release lever 4. The spring 14 is preferably a coil spring 14.

In the FIGURE, the locking mechanism 1, 2, 3 is locked. The pawl 3 has moved into the main-ratchet position 1*a* after the locking bolt 9 has entered the catch 1. The catch 1 thus assumes its main-ratchet position 1*a*. The blocking lever 10 mounted on axis 5 and elastically connected to the release lever 4 by means of the spring 14, clasps the cam 2*a* of the blocking lever 2 in such a way that the blocking lever 2 is prevented from leaving its blocking position. The FIGURE shows the not required state, i.e. the resting position. This is the so-called normal state of the motor vehicle lock.

As soon as it is in this position and provided that no abnormal accelerations are experienced, the release lever 4 is acted upon in such a way that it moves, if a door handle—not shown—is actuated, in clockwise direction around its axis 5 in the indicated clockwise direction, this pivoting movement of the release lever 4 ensuring that the blocking lever 10, also mounted on axis 5, is also pivoted around this axis 5 in clockwise direction, i.e. released from the clasp of the cam 2*a*. This is ensured by spring 14, coupling the release lever 4 and the blocking lever 10. During this process, the blocking lever 10 is pivoted around its axis 5 in clockwise direction as indicated by the arrow in the FIGURE. This is a so-called opening operation state of the motor vehicle door lock.

As part of the described opening operation, the release lever 4 and the blocking lever 10 move, at least in essence, synchronously. During this process, the blocking lever 10 releases the pawl 2 previously retained by the cam 2*a*. As a result, the release lever 4 can, during its continued movement, pivot the journal and thus the blocking pawl 2 with its actuating edge 6.

The actuating edge 6 engaging with the blocking pawl 2 ensures that the blocking pawl 2 carries out the counter-clockwise movement around its axis 7 as indicated in the FIGURE. As a result, the pawl 3 can be lifted off the catch 1 by the introduced opening moment, said catch in turn preferably opening with the aid of a spring and releasing the previously retained locking bolt 9. This corresponds to the normal operation in which the blocking lever 10 releases the locking mechanism 1, 2, 3 or the blocking pawl 2.

In one embodiment, a spring on the blocking lever 10—not shown—ensures that during closure of the locking mechanism 1, 2, 3, the blocking lever 10 is returned to its original position, also in the not required state, i.e. the resting state, by the movement of the release lever 4. Preferably, the spring on the blocking lever 10 is mounted on the same axis as the blocking lever itself. The spring is advantageously a coil spring.

Where, starting from the functional position shown in the FIGURE, a crash occurs, the release lever 4 can be deflected as a result. In other words, the release lever 4 would be acted upon in a similar manner in clockwise direction around its axis 5 as in case of a "normal" actuation. In contrast to this "normal" actuation, forces of inertia do, however, appear in the event of a crash. The moment of inertia of the blocking lever 10 is such that in the described crash situation, the blocking lever 10 is not synchronously pivoted with the release lever 4 and the blocking pawl 2 is reliably blocked by blocking lever 10. The design is also such that the release lever 4 deflected in the assumed crash scenario can also not deflect the blocking lever 10 with the tensioned spring 14, thus ensuring the reliable blocking of the locking mechanisms 1, 2, 3.

Preferably, the blocking lever 10 is made of a single piece as shown and is essentially straight. The lever is, in particular, several times longer than wide. This also reduces the space required.

The invention claimed is:

1. A lock containing a locking mechanism comprising a catch and a pawl for locking the catch, a blocking pawl for blocking the pawl during locking and a release lever for releasing the pawl and a blocking lever, able to prevent the locking mechanism from opening during high levels of acceleration, characterized in that the release lever and the blocking lever are mounted on the same axis.

2. The lock according to claim 1, characterized in that the blocking lever contains a blocking contour interacting with the locking mechanism.

3. The lock according to claim 2, characterized in that the blocking lever can prevent the blocking pawl from leaving its blocking position.

4. The lock according to claim 3, characterized in that the blocking contour of the blocking lever can retain a cam of the blocking pawl.

5. The lock according to claim 1, characterized in that the release lever, the blocking pawl and the blocking lever are mounted on a common axis.

6. The lock according to claim 1, characterized in that the locking mechanism and the blocking lever arranged on an axis of the release lever are arranged in a lock case.

7. The lock according to claim 1, characterized in that the blocking lever is mechanically coupled to the release lever.

8. The lock according to claim 7, characterized in that an elastic coupling is provided between the blocking lever and the release lever.

9. The lock according to claim 7, characterized in that the blocking lever and the release lever are elastically coupled by at least one spring.

10. The lock according to claim 7, characterized in that a moment of inertia of the blocking lever is such that in the event of a crash the locking mechanism cannot be opened.

11. The lock according to claim 7, characterized in that the forces of inertia of the blocking lever active in the event of a crash exceed the coupling forces to the release lever.

12. The lock according to claim 7, characterized in that the blocking lever is a single-arm lever.

13. The lock according to claim 1, characterized in that the blocking lever can prevent the blocking pawl from leaving its blocking position.

14. The lock according to claim 1, characterized in that the blocking lever and the release lever are elastically coupled by at least one spring.

15. The lock according to claim 1, characterized in that a moment of inertia of the blocking lever is such that in the event of a crash the locking mechanism cannot be opened.

16. The lock according to claim 1, characterized in that the forces of inertia of the blocking lever active in the event of a crash exceed the coupling forces to the release lever.

17. The lock according to claim 1, characterized in that the blocking lever is a single-arm lever.

18. The lock according to claim 12, wherein the blocking lever extends essentially in a straight line starting from its axis.

19. The lock according to claim 17, wherein the blocking lever extends essentially in a straight line starting from its axis.

* * * * *